US010329633B2

(12) United States Patent
Fujimura et al.

(10) Patent No.: US 10,329,633 B2
(45) Date of Patent: Jun. 25, 2019

(54) HIGH-STRENGTH SEAMLESS STAINLESS STEEL PIPE FOR OIL COUNTRY TUBULAR GOODS AND METHOD FOR MANUFACTURING THE SAME

(71) Applicant: JFE STEEL CORPORATION, Tokyo (JP)

(72) Inventors: Kazuki Fujimura, Handa (JP); Yasuhide Ishiguro, Handa (JP); Tetsu Nakahashi, Handa (JP); Hideo Sato, Handa (JP)

(73) Assignee: JFE STEEL CORPORATION, Tokyo (JP)

( * ) Notice: Subject to any disclaimer, the term of this patent is extended or adjusted under 35 U.S.C. 154(b) by 265 days.

(21) Appl. No.: 15/311,907

(22) PCT Filed: May 20, 2015

(86) PCT No.: PCT/JP2015/002535
§ 371 (c)(1),
(2) Date: Nov. 17, 2016

(87) PCT Pub. No.: WO2015/178022
PCT Pub. Date: Nov. 26, 2015

(65) Prior Publication Data

US 2017/0096722 A1 Apr. 6, 2017

(30) Foreign Application Priority Data

May 21, 2014 (JP) ..... 2014-105039

(51) Int. Cl.
*C22C 38/40* (2006.01)
*C22C 38/44* (2006.01)
(Continued)

(52) U.S. Cl.
CPC ..... *C21D 9/08* (2013.01); *C21D 1/22* (2013.01); *C21D 6/004* (2013.01); *C21D 8/005* (2013.01);
(Continued)

(58) Field of Classification Search
None
See application file for complete search history.

(56) References Cited

U.S. PATENT DOCUMENTS

2007/0074793 A1 4/2007 Kimura et al.

FOREIGN PATENT DOCUMENTS

CN 1875121 A 12/2006
JP S62-13527 A 1/1987
(Continued)

OTHER PUBLICATIONS

Machine-English translation of JP 62-013556, Kakihara Setsuo et al., Jan. 22, 1987.*
(Continued)

*Primary Examiner* — Deborah Yee
(74) *Attorney, Agent, or Firm* — Oliff PLC

(57) ABSTRACT

A high-strength seamless stainless steel pipe for oil country tubular goods that is excellent in terms of hot workability, sulfide stress cracking resistance, and corrosion resistance, and a method for manufacturing the steel pipe. The steel pipe has a chemical composition containing Cr and Ni so that the relationship Cr/Ni≤5.3 is satisfied. A microstructure of the steel pipe includes mainly a tempered martensite phase. Additionally, a surface layer microstructure of the steel pipe includes a phase which looks white when subjected to etching with a Vilella etching solution, the phase having a thickness in the wall thickness direction from the outer surface of the pipe of 10 μm or more and 100 μm or less and
(Continued)

dispersing in the outer surface of the pipe in an amount of 50% or more in terms of area fraction.

11 Claims, 1 Drawing Sheet

(51) Int. Cl.

| | |
|---|---|
| ***C22C 38/46*** | (2006.01) |
| ***C22C 38/48*** | (2006.01) |
| ***C22C 38/50*** | (2006.01) |
| ***C22C 38/42*** | (2006.01) |
| ***C21D 8/10*** | (2006.01) |
| ***C21D 9/08*** | (2006.01) |
| ***C22C 38/58*** | (2006.01) |
| ***C21D 1/22*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/54*** | (2006.01) |
| ***C21D 6/00*** | (2006.01) |
| *C21D 9/00* | (2006.01) |

(52) U.S. Cl.

CPC ..... *C21D 8/10* (2013.01); *C21D 8/105* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 9/00* (2013.01); *C21D 2211/008* (2013.01)

(56) References Cited

FOREIGN PATENT DOCUMENTS

| | | | |
|---|---|---|---|
| JP | S62-13556 | A | 1/1987 |
| JP | H04-168221 | A | 6/1992 |
| JP | H06-33146 | A | 2/1994 |
| JP | H08-90043 | A | 4/1996 |
| JP | H10-60538 | A | 3/1998 |
| JP | 10-001755 | | 7/1999 |
| JP | H11-239806 | A | 9/1999 |
| JP | 2005-068490 | A | 3/2005 |
| JP | 2005-336595 | A | 12/2005 |
| JP | 2008-081793 | A | 4/2008 |
| WO | 2004/001082 | A1 | 12/2003 |

OTHER PUBLICATIONS

Machine-English translation of JP 2008-081793, Kimura Mitsuo et al., Apr. 10, 2008.*

Mar. 24, 2017 Search Report issued in European Patent Application No. 15795740.8.

Nov. 1, 2017 Office Action issued in Chinese Patent Application No. 201580025753.0.

Aug. 25, 2015 International Search Report issued in International Application No. PCT/JP2015/002535.

Aug. 22, 2018 Office Action issued in European Application No. 15 795 740.8.

* cited by examiner

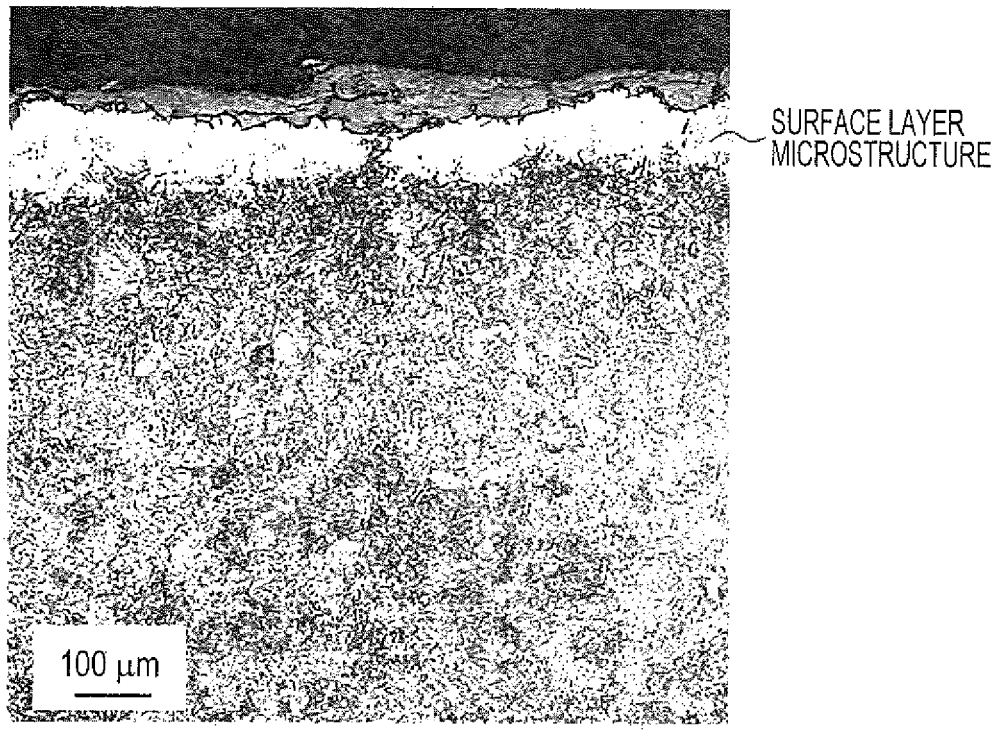
SURFACE LAYER
MICROSTRUCTURE
100 μm

HIGH-STRENGTH SEAMLESS STAINLESS STEEL PIPE FOR OIL COUNTRY TUBULAR GOODS AND METHOD FOR MANUFACTURING THE SAME

TECHNICAL FIELD

The present disclosure relates to a high-strength seamless stainless steel pipe for oil country tubular goods which can preferably be used for oil wells and gas wells in very harsh corrosive environments containing carbon dioxide ($CO_2$), chlorine ions ($Cl^-$), and so forth, and to a method for manufacturing the steel pipe, in particular, to improvement in hot workability, sulfide stress cracking resistance, and corrosion resistance.

BACKGROUND ART

Nowadays, deep oil fields to which consideration has never been given, sour gas fields whose development was abandoned due to their harsh corrosive environments, and so forth are being actively developed on a global scale from the viewpoint of a sharp rise in the price of crude oil and the exhaustion of oil resources which is anticipated in the near future. Such oil fields and gas fields are generally found very deep in the ground and in harsh corrosive environments in which the atmosphere has a high temperature and contains $CO_2$, $Cl^-$, and so forth. Therefore, as a steel pipe for oil country tubular goods which are used in order to drill such oil fields and gas fields, there is a strong demand for a seamless steel pipe having not only a high strength corresponding to a yield stress of higher than 654 MPa (95 ksi), but also excellent corrosion resistance.

In response to such requirements, for example, Patent Literature 1 describes martensitic stainless steel excellent in terms of corrosion resistance and sulfide stress cracking resistance. The martensitic stainless steel according to Patent Literature 1 is martensitic stainless steel excellent in terms of corrosion resistance and sulfide stress cracking resistance having a chemical composition containing, by weight %, C: 0.005% to 0.05%, Si: 0.05% to 0.5%, Mn: 0.1% to 1.0%, P: 0.025% or less, S: 0.015% or less, Cr: 10% to 15%, Ni: 4.0% to 9.0%, Cu: 0.5% to 3%, Mo: 1.0% to 3.0%, Al: 0.005% to 0.2%, and N: 0.005% to 0.1%, in which the condition that Ni equivalent is −10 or more is satisfied, and a microstructure including a tempered martensite phase, a martensite phase, and a retained austenite phase, in which the sum of the fraction of a tempered martensite phase and the fraction of a martensite phase is 60% to 90%, and Patent Literature 1 states that it is possible to manufacture the martensitic stainless steel by performing a two-step heat treatment including a heat treatment at a temperature equal to or lower than a temperature at which an austenite phase fraction is 80% and a heat treatment at a temperature equal to or lower than a temperature at which an austenite phase fraction is 60%. Patent Literature 1 states that, with this, it is possible to achieve excellent hot workability, a yield stress of 551 MPa to 861 MPa (80 ksi to 110 ksi), improved corrosion resistance in an aqueous carbon dioxide environment, and improved sulfide stress cracking resistance in an aqueous hydrogen sulfide environment.

In addition, Patent Literature 2 describes a stainless steel pipe for oil country tubular goods. The steel pipe according to Patent Literature 2 is a stainless steel pipe for oil country tubular goods excellent in terms of corrosion resistance having a chemical composition containing, by mass %, C: 0.05% or less, Si: 0.50% or less, Mn: 0.20% to 1.80%, Cr: 14.0% to 18.0%, Ni: 5.0% to 8.0%, Mo: 1.5% to 3.5%, Cu: 0.5% to 3.5%, Al: 0.05% or less, V: 0.20% or less, N: 0.01% to 0.15%, and O: 0.006% or less, in which the relationships $Cr+0.65Ni+0.6Mo+0.55Cu-20C \geq 18.5$ and $Cr+Mo+0.3Si-43.5C-0.4Mn-Ni-0.3Cu-9N \leq 11$ are satisfied, and Patent Literature 2 states that it is possible to obtain the steel pipe by performing, after a pipe-making process has been performed, a quenching treatment including performing heating to a temperature equal to or higher than the $Ac_3$ transformation temperature and then performing cooling to room temperature at a cooling rate equal to or larger than that of air cooling and performing a tempering treatment at a temperature equal to or lower than the $Ac_1$ transformation temperature. Patent Literature 2 states that, with this, it is possible to achieve a high strength corresponding to a yield stress of higher than 654 MPa (95 ksi) and excellent corrosion resistance even in a harsh corrosive environment containing $CO_2$, $Cl^-$, and so forth and having a temperature higher than 180° C. and equal to or lower than 230° C.

In addition, Patent Literature 3 describes a high-strength stainless steel pipe for oil country tubular goods excellent in terms of corrosion resistance. The steel pipe according to Patent Literature 3 is a steel pipe having a chemical composition containing, by mass %, C: 0.005% to 0.05%, Si: 0.05% to 0.5%, Mn: 0.2% to 1.8%, P: 0.03% or less, S: 0.005% or less, Cr: 15.5% to 18%, Ni: 1.5% to 5%, Mo: 1% to 3.5%, V: 0.02% to 0.2%, N: 0.01% to 0.15%, and O: 0.006% or less, in which the relationships $Cr+0.65Ni+0.6Mo+0.55Cu-20C \geq 19.5$ and $Cr+Mo+0.3Si-43.5C-0.4Mn-Ni-0.3Cu-9N \geq 11.5$ are satisfied, and, preferably, a microstructure including a martensite phase as a base phase, a ferrite phase in an amount of 10% to 60% or more in terms of volume fraction, and, optionally, a retained austenite phase in an amount of 30% or less in terms of volume fraction. Patent Literature 3 states that, with this, it is possible to achieve improved hot workability so that cracking in a pipe-making process is prevented, a high strength corresponding to a yield stress of higher than 654 MPa (95 ksi) and excellent corrosion resistance even in an harsh corrosive environment which contains $CO_2$, $Cl^-$, and so forth and which has a temperature of 230° C.

CITATION LIST

Patent Literature

[PTL 1] Japanese Unexamined Patent Application Publication No. 10-1755

[PTL 2] Domestic Re-publication of PCT International Publication for Patent Application No. WO2004-001082

[PTL 3] Japanese Unexamined Patent Application Publication No. 2005-336595

SUMMARY

Technical Problem

In the case of the techniques according to Patent Literature 1 through Patent Literature 3, satisfactory corrosion resistance against a harsh corrosive environment is provided by adding large amount of expensive alloy chemical elements. However, since the addition of large amount of alloy chemical elements causes deterioration in hot workability, there is a problem of deterioration in pipe making capability.

Therefore, an object of the present disclosure is, by solving the problems with the conventional techniques described above, to provide a high-strength seamless stainless steel pipe for oil country tubular goods which is inexpensive, excellent in terms of pipe making capability as a result of being excellent in terms of hot workability, excellent in terms of sulfide stress cracking resistance, and excellent in terms of corrosion resistance. Here, the term "high-strength" refers to a strength corresponding to a yield stress of higher than 654 MPa (95 ksi). In addition, the term "excellent in terms of corrosion resistance" here refers to a case where, when the corrosion weight loss is determined after a test piece has been immersed in a test solution, that is, a 20 mass %-NaCl aqueous solution (having a temperature of 160° C. and a $CO_2$ partial pressure of 5.0 MPa) contained in an autoclave for 720 hours, the corrosion rate is 0.127 mm/year or less.

Solution to Problem

The present inventors, in order to achieve the object described above, diligently conducted investigations regarding the influence of microstructure on corrosion resistance. To date, in the case of a martensitic stainless steel pipe, the desired corrosion resistance has been achieved by achieving the stability of a passivation film as a result of controlling the amount of alloy chemical elements such as Cr, Mo, and Ni to be within appropriate ranges, under the assumption that uniform distribution of constituent chemical elements and homogeneous microstructure are achieved. Therefore, unlike in the case of conventional techniques, the present inventors, by focusing on an inhomogeneous microstructure to which consideration has never been given, tried to improve the corrosion resistance of a stainless steel pipe by utilizing an inhomogeneous microstructure.

As a result, it was found that, in the case where a layer having a special microstructure (inhomogeneous microstructure) which is different from a parent phase is formed in the outer surface layer of a stainless steel pipe, there is a case of significant improvement in corrosion resistance. This layer is a layer including a phase (white phase) which looks white when subjected to etching with a general Vilella (picric acid) etching solution. It was found that this white phase is a phase which includes mainly a martensite phase, which is less likely to be etched by a Vilella (picric acid) etching solution, and which is excellent in terms of corrosion resistance. Also, from the results of additional investigations, it was found that this white phase is formed as a result of the formation of a chemical composition in which Ni is relatively concentrated as a result of Cr being expended due to the oxidation of the surface.

Therefore, the present inventors, by conducting additional investigations, found that, by forming a surface layer microstructure in which such a white phase occupies a portion from the surface to an appropriate depth in the thickness direction and disperses in the pipe surface in an appropriate amount in terms of area fraction, it is possible to stably improve the corrosion resistance of a stainless steel pipe.

In addition, the present inventors found that, by forming a surface layer microstructure in which a white phase occupies a portion from the surface to an appropriate depth in the thickness direction and disperses in the pipe surface in an appropriate amount in terms of area fraction, it is possible to improve hot workability and sulfide stress cracking resistance.

In addition, although, in the case of conventional manufacturing methods, the oxygen concentration in a heating furnace before a pipe-making process is controlled to be 1% or less in order to inhibit the oxidation of a pipe surface or is left uncontrolled so as to be about 10%, the present inventors found that, by controlling the oxygen concentration so as to take an intermediate value between such values, it is possible to form a white phase in the surface layer having an appropriate depth and area fraction. In addition, the present inventors found that it is possible to control the depth of a white phase by controlling the heating furnace temperature, heating time, and oxygen concentration.

The present disclosure has been completed on the basis of the knowledge described above and additional investigations. Exemplary disclosed embodiments include as follows.

(1) A high-strength seamless stainless steel pipe for oil country tubular goods, the steel pipe having a chemical composition containing Cr and Ni and a microstructure including mainly a tempered martensite phase, in which the chemical composition satisfies the relational expression (1) below, and in which a surface layer microstructure includes a phase which looks white when subjected to etching with a Vilella etching solution, which has a thickness in the wall thickness direction from the outer surface of the pipe of 10 μm or more and 100 μm or less, and which disperses in the outer surface of the pipe in an amount of 50% or more in terms of area fraction.

$$Cr/Ni \leq 5.3 \quad (1),$$

where Cr and Ni respectively denote the contents (mass %) of the corresponding chemical elements.

(2) The high-strength seamless stainless steel pipe for oil country tubular goods according to item (1), the steel pipe having the chemical composition containing, by mass %, C: 0.005% or more and 0.05% or less, Si: 0.05% or more and 1.50% or less, Mn: 0.2% or more and 1.8% or less, P: 0.02% or less, S: 0.005% or less, Cr: 11% or more and 18% or less, Ni: 0.10% or more and 8.0% or less, Mo: 0.6% or more and 3.5% or less, and the balance being Fe and inevitable impurities.

(3) The high-strength seamless stainless steel pipe for oil country tubular goods according to item (2), the steel pipe having the chemical composition further containing, by mass %, one or both selected from among V: 0.02% or more and 0.2% or less and N: 0.01% or more and 0.15% or less.

(4) The high-strength seamless stainless steel pipe for oil country tubular goods according to item (2) or (3), the steel pipe having the chemical composition further containing, by mass %, one, or more selected from among group A through group D below.

Group A: Al: 0.002% or more and 0.050% or less

Group B: Cu: 3.5% or less

Group C: one, or more selected from among Nb: 0.2% or less, Ti: 0.3% or less, Zr: 0.2% or less, W: 3.0% or less, and B: 0.01% or less Group D: Ca: 0.01% or less (5) A method for manufacturing a high-strength seamless stainless steel pipe for oil country tubular goods, the method including, when a high-strength seamless steel pipe is manufactured by heating a steel material in a heating furnace, by forming the steel material into a seamless steel pipe, and by performing a quenching treatment and a tempering treatment on the seamless steel pipe, using a steel material containing Cr and Ni so that relational expression (1) below is satisfied in terms of mass % as the steel material, and performing heating in the heating furnace in an atmosphere having an oxygen concentration of 2% or more and 5% or less in terms of volume fraction at a temperature of 1250° C. or higher and 1300° C. or lower, and the high-strength seamless steel pipe having a microstructure including mainly a tempered martensite phase, in which a surface layer microstructure includes a phase which looks white when subjected to etching with a Vilella etching solution, which has a thickness in the wall thickness direction from the outer surface of the pipe of 10 μm or more and 100 μm or less, and which disperses in the outer surface of the pipe in an amount of 50% or more in terms of area fraction.

$$Cr/Ni \leq 5.3 \quad (1),$$

where Cr and Ni respectively denote the contents (mass %) of the corresponding chemical elements.

(6) The method for manufacturing a high-strength seamless stainless steel pipe for oil country tubular goods according to item (5), the high-strength seamless steel pipe having the chemical composition containing, by mass %, C: 0.005% or more and 0.05% or less, Si: 0.05% or more and 1.50% or less, Mn: 0.2% or more and 1.8% or less, P: 0.02% or less, S: 0.005% or less, Cr: 11% or more and 18% or less, Ni: 0.10% or more and 8.0% or less, Mo: 0.6% or more and 3.5% or less, and the balance being Fe and inevitable impurities.

(7) The method for manufacturing a high-strength seamless stainless steel pipe for oil country tubular goods according to item (6), the high-strength seamless steel pipe having the chemical composition further containing, by mass %, one or both selected from among V: 0.02% or more and 0.2% or less and N: 0.01% or more and 0.15% or less.

(8) The method for manufacturing a high-strength seamless stainless steel pipe for oil country tubular goods according to item (6) or (7), the high-strength seamless steel pipe having the chemical composition further containing, by mass %, one, or more selected from among group A through group D below.

Group A: Al: 0.002% or more and 0.050% or less

Group B: Cu: 3.5% or less

Group C: one, or more selected from among Nb: 0.2% or less, Ti: 0.3% or less, Zr: 0.2% or less, W: 3.0% or less, and B: 0.01% or less Group D: Ca: 0.01% or less Here, the term "white" in the present disclosure refers to the quality of having a white appearance compared with a parent phase when observed by using an ordinary optical microscope under conditions regarding brightness and contrast in which it is possible to sufficiently observe the parent phase microstructure which has been exposed by performing etching. In addition, the term "parent phase" here refers to a homogeneous phase which occupies most of the portion inside the steel other than that in the vicinity of the surface.

In addition, etching with a Vilella (picric acid) etching solution is performed by immersing a sample in a Vilella reagent (1 vol. %-picric acid+5 vol. % to 15 vol. %-hydrochloric acid+ethanol) for several seconds after having mechanically polished the surface of the sample by using a buff polishing method. Since an appropriate degree of etching depends on the microstructure and constituent chemical elements of the steel, the immersing time is appropriately controlled so that the microstructure is clearly observed by confirming that the microstructure is exposed by using an optical microscope after etching has been performed. In addition, the term "dispersion" in the present disclosure refers not only to a state in which a phase having a white appearance disperses in the surface layer microstructure, but also to a state in which a phase having a white appearance covers the surface layer microstructure.

Advantageous Effects

According to the present disclosure, it is possible to manufacture a high-strength seamless stainless steel pipe for oil country tubular goods which has a high strength corresponding to a yield stress of 654 MPa or more, which has excellent corrosion resistance even in a high-temperature harsh corrosive environment containing $CO_2$, $Cl^-$, and so forth, and which is excellent in terms of hot workability and sulfide stress cracking resistance with low cost and high productivity, which has a marked effect on the industry.

BRIEF DESCRIPTION OF DRAWINGS

FIG. 1 illustrates one of the examples of the microstructure in the vicinity of the surface layer of the seamless steel pipe according to the present disclosure.

DESCRIPTION OF EMBODIMENTS

The seamless steel pipe according to the present disclosure is a steel pipe having chemical composition of stainless steel containing Cr and Ni so that the following relational expression (1) is satisfied.

$$Cr/Ni \leq 5.3 \quad (1),$$

(where Cr and Ni respectively denote the contents (mass %) the corresponding chemical elements.)

In the case where the contents of Cr and Ni do not satisfy relational expression (1), since there is a decrease in the relative concentration of Ni with respect to Cr, it is not possible to form the desired surface layer microstructure, which makes it impossible to achieve the desired corrosion resistance. Therefore, the contents of Cr and Ni are controlled so as to satisfy relational expression (1). Here, it is preferable that Cr/Ni be more than 1.5. With this, it is possible to control the thickness of a white phase (surface layer microstructure) to be 100 μm or less. In the case where the thickness of a white phase (surface layer microstructure) is more than 100 μm, there is deterioration in hot workability.

It is preferable that the chemical composition of stainless steel of the seamless steel pipe according to the present disclosure contain, specifically, by mass %, C: 0.005% or more and 0.05% or less, Si: 0.05% or more and 1.50% or less, Mn: 0.2% or more and 1.8% or less, P: 0.02% or less, S: 0.005% or less, Cr: 11% or more and 18% or less, Ni: 0.10% or more and 8.0% or less, Mo: 0.6% or more and 3.5% or less, and the balance being Fe and inevitable impurities, in which Cr and Ni satisfy relational expression (1) above.

Hereafter, the reasons for the limitations on the chemical composition of the seamless steel pipe according to the present disclosure will be described. Hereinafter, mass % when describing a chemical composition will be simply refers to as "1".

C: 0.005% or More and 0.05% or Less

C is an important chemical element which is related to the strength of steel, and it is preferable that the C content be 0.005% or more in order to achieve the desired strength in the present disclosure. On the other hand, in the case where the C content is more than 0.05%, there is a case of improvement in the degree of sensitization in a tempering process due to the addition of Ni. Therefore, it is preferable that the C content be limited to 0.005% or more and 0.05% or less. Here, although it is preferable that the C content be as small as possible from the viewpoint of improving corrosion resistance, it is more preferable that the C content be 0.03% or more and 0.05% or less in consideration of the balance between the improvement of corrosion resistance and the stable achievement of strength.

Si: 0.05% or More and 1.50% or Less

Si is a chemical element which functions as a deoxidizing agent, and it is preferable that the Si content be 0.05% or more in order to realize such an effect. On the other hand, in the case where the Si content is more than 1.50%, there is deterioration in $CO_2$ corrosion resistance, and there is a case of deterioration in hot workability. Therefore, it is preferable that the Si content be limited to 0.05% or more and 1.50% or less. It is more preferable that the Si content be 0.10% or more. In addition, it is more preferable that the Si content be 0.50% or less.

Mn: 0.2% or More and 1.8% or Less

Mn is a chemical element which has a function of improving strength, and it is preferable that the Mn content be 0.2% or more in order to achieve the desired strength in the present disclosure. On the other hand, in the case where the Mn content is more than 1.8%, there is a negative effect on toughness. Therefore, it is preferable that the Mn content be limited to 0.2% or more and 1.8% or less, or more preferably 0.2% or more and 1.6% or less.

P: 0.02% or Less

Since P is a chemical element which has a function of deteriorating all of $CO_2$ corrosion resistance, $CO_2$ stress corrosion cracking resistance, pitting corrosion resistance, and sulfide stress cracking resistance, it is preferable that the P content be as small as possible in the present disclosure. However, in the case where the P content is excessively small, there is increase in refining costs. Therefore, it is preferable that the P content be 0.005% or more, which is within an industrially realizable range at comparatively low cost. In addition, in the case where the P content is 0.02% or less, the degrees of deterioration in $CO_2$ corrosion resistance, $CO_2$ stress corrosion cracking resistance, pitting corrosion resistance, and sulfide stress cracking resistance are acceptable. Therefore, it is preferable that the P content be limited to 0.02% or less, or more preferably 0.01% or less.

S: 0.005% or Less

Since S is a chemical element which has a function of significantly deteriorating productivity in a steel pipe manufacturing process as a result of significantly deteriorating the hot workability of steel, it is preferable that the S content be as small as possible. However, in the case where the S content is excessively small, there is increase in refining costs. Therefore, it is preferable that the S content be 0.001% or more, which is within an industrially realizable range at comparatively low cost. Here, in the case where the S content is 0.005% or less, it is possible to manufacture a steel pipe by using an ordinary manufacturing process. Therefore, it is preferable that the S content be limited to 0.005% or less, or more preferably 0.002% or less.

Cr: 11% or More and 18% or Less

Cr is a chemical element which has a function of improving corrosion resistance by forming a protective film on the surface of steel and which, in particular, contributes to improving $CO_2$ corrosion resistance and $CO_2$ stress corrosion cracking resistance. In the present disclosure, it is preferable that the Cr content be 11% or more from the viewpoint of improving corrosion resistance at a high temperature. On the other hand, in the case where the Cr content is more than 18%, there is deterioration in hot workability, and there is a case of lowering in yield strength. Therefore, it is preferable that the Cr content be limited to 11% or more and 18% or less, or more preferably 11.5% or more and 18% or less.

Ni: 0.10% or More and 8.0% or Less

Ni is a chemical element which has a function of improving $CO_2$ corrosion resistance, $CO_2$ stress corrosion cracking resistance, pitting corrosion resistance, and sulfide stress cracking resistance by improving the strength of a protective film formed on the surface of steel and which improves the strength of steel through solid solution strengthening. Such effects are realized in the case where the Ni content is 0.10% or more. On the other hand, in the case where the Ni content is more than 8.0%, since there is deterioration in the stability of a martensite phase, there is a case of deterioration in strength. Therefore, it is preferable that the Ni content be limited to 0.10% or more and 8.0% or less, more preferably 2.0% or more and 8.0% or less, or even more preferably 3.5% or more and 7.0% or less.

Here, it is preferable the contents of Cr and Ni of the seamless steel pipe according to the present disclosure be controlled to be within the ranges described above and controlled so as to satisfy relational expression (1) above.

Mo: 0.6% or More and 3.5% or Less

Mo is a chemical element which has a function of improving the resistance (pitting corrosion resistance) to pitting corrosion which is caused by chlorine ions ($Cl^-$). In order to realize such an effect, it is preferable that the Mo content be 0.6% or more. In the case where the Mo content is less than 0.6%, there is a case of insufficient corrosion resistance in a high-temperature harsh corrosive environment. On the other hand, in the case where the Mo content is more than 3.5%, there is a case of deterioration in strength. Here, since Mo is an expensive chemical element, there is increase in material costs in the case where the Mo content is large. Therefore, it is preferable that the Mo content be limited to 0.6% or more and 3.5% or less, or more preferably 0.6% or more and 2.8% or less.

Although the chemical composition described above is the basic chemical composition, in addition to the basic chemical composition, one or both selected from among V: 0.02% or more and 0.20% or less and N: 0.01% or more and 0.15% or less and/or one, more selected from among group A through group D may be added as selective chemical elements.

One or both selected from among V: 0.02% or more and 0.2% or less and N: 0.01% or more and 0.15% or less V and N are both chemical elements which improve corrosion resistance, and one or both selected from among these chemical elements may selectively be added in the present disclosure.

V is a chemical element which improves corrosion resistance and stress corrosion cracking resistance and which has a function of improving the strength of steel. Such effects are markedly realized in the case where the V content is 0.02% or more. On the other hand, in the case where the V content is more than 0.2%, there is a case of deterioration in toughness. Therefore, in the case where V is added, it is preferable that the V content be limited to 0.02% or more and 0.2% or less, or more preferably 0.02% or more and 0.08% or less.

N is a chemical element which has a function of significantly improving pitting corrosion resistance. Although N is usually contained in steel as an inevitable impurity in an amount of less than about 0.01%, in order to realize such an effect in the present disclosure, the N content is set to be 0.01% or more. On the other hand, in the case where the N content is more than 0.15%, there is deterioration in toughness as a result of forming various nitrides. Therefore, in the case where N is particularly added, it is preferable that the N content be limited to 0.01% or more and 0.15% or less. It is more preferable that the N content be 0.02% or more. In addition, it is more preferable that the N content be 0.08% or less.

One, or More Selected from Among Group A Through Group D

In the present disclosure, one, or more selected from among group A through group D may be added as needed as selective chemical elements. Here, group A consists of Al: 0.002% or more and 0.050% or less, group B consists of Cu: 3.5% or less, group C consists of one, or more selected from among Nb: 0.2% or less, Ti: 0.3% or less, Zr: 0.2% or less, W: 3.0% or less, and B: 0.01% or less, and group D consists of Ca: 0.01% or less.

Group A: Al is a chemical element which functions as a deoxidizing agent, and Al may selectively be added as needed. In order to realize such an effect, it is preferable that the Al content be 0.002% or more. On the other hand, in the case where the Al content is more than 0.050%, there is a negative effect on toughness. Therefore, in the case where group A is added, it is preferable that the content of group A: Al be limited to 0.002% or more and 0.050% or less. It is more preferable that the Al content be 0.03% or less. In the case where Al is not added, it is acceptable that group A: Al be contained as an inevitable impurity in an amount of less than about 0.002%. In the case where the content of group A: Al is limited to less than about 0.002%, there is an advantage in that there is a significant improve in sulfide stress cracking resistance.

Group B: Cu is a chemical element which has a function of improving sulfide stress cracking resistance by inhibiting hydrogen ingress into steel as a result of improving the strength of a protective film, and Cu may selectively be added as needed. In order to realize such an effect, it is preferable that the Cu content be 0.5% or more. However, in the case where the Cu content is more than 3.5%, there is a case of deterioration in hot workability due to the grain boundary precipitation of CuS. Therefore, in the case where group B is added, it is preferable that the content of group B: Cu be limited to 3.5% or less. It is more preferable that the Cu content be 0.5% or more and 2.5% or less.

Group C: Nb, Ti, Zr, W, and B are all chemical elements which improve strength, and one, or more selected from among these chemical elements may be added as needed. In order to realize such an effect, it is preferable that the Nb content be 0.03% or more, the Ti content be 0.03% or more, the Zr content be 0.03% or more, the W content be 0.2% or more, and the B content be 0.0005% or more. On the other hand, in the case where the Nb content is more than 0.2%, the Ti content is more than 0.3%, the Zr content is more than 0.2%, the W content is more than 3.0%, or the B content be more than 0.01%, there is a case of deterioration in toughness. Therefore, in the case where group C is added, it is preferable that the Nb content be limited to 0.2% or less, the Ti content be limited to 0.3% or less, the Zr content be limited to 0.2% or less, the W content be limited to 3.0% or less, and the B content be limited to 0.01% or less.

Group D: Ca is a chemical element which has a function of spheroidizing the shape of sulfide-based inclusions, and Ca may be added as needed. Such an effect is markedly realized in the case where the Ca content is 0.0005% or more. On the other hand, in the case where the Ca content is more than 0.01%, since there is an increase in the amount of CaO, there is a case of deterioration in $CO_2$ corrosion resistance and pitting corrosion resistance. Therefore, in the case where Ca is added, it is preferable that the Ca content be limited to 0.01% or less, or more preferably 0.001% or less.

The remainder other than those above is Fe and inevitable impurities. As inevitable impurities, O: 0.006% or less and N: less than 0.01% are acceptable.

Here, since O has a negative effects on various properties as a result of existing in steel in the form of oxides, it is preferable that the O content be as small as possible in order to improve the properties. In particular, in the case where the O content is more than 0.006%, there is a case of deterioration in hot workability, $CO_2$ stress corrosion cracking resistance, pitting corrosion resistance, sulfide stress cracking resistance, and toughness. Therefore, it is preferable that the content of O, which is an inevitable impurity, be 0.006% or less.

The seamless steel pipe according to the present disclosure has a microstructure including a tempered martensite phase as a main phase in addition to the chemical composition described above. The term "main phase" here refers to a phase which constitutes, in terms of volume fraction, 50% or more of the whole microstructure. Examples of second phases other than a tempered martensite phase include a ferrite phase and a retained austenite phase which constitute, in terms of volume fraction, less than 50% of the whole microstructure. In the case where the second phases constitute, in terms of volume fraction, 50% or more of the whole microstructure, it is not possible to achieve the desired strength. Here, it is preferable that the phase fraction of the second phases be 40% or less.

In addition, the seamless steel pipe according to the present disclosure has, in the outer surface layer of the pipe, a surface layer microstructure in which a phase (white phase) which looks white when subjected to etching with a Vilella etching solution has a thickness in the wall thickness direction from the outer surface of the pipe of 10 μm or more and disperses in the outer surface of the pipe in an amount of 50% or more in terms of area fraction. The term "outer surface layer of pipe" here refers to a region within 100 μm in the wall thickness direction from the outer surface of the pipe. In addition, the term "dispersion" in the present disclosure refers not only to a state in which a phase having a white appearance disperses in the surface layer microstructure but also to a state in which a phase having a white appearance covers the surface layer microstructure.

The term "white phase" here refers to a phase which looks white when subjected to etching with a general Vilella (picric acid) etching solution. As a result of observation using a scanning electron microscope, it is clarified that this white phase is a phase which includes mainly a martensite phase and which is excellent in terms of corrosion resistance. By dispersing (forming) such a "white phase" having an appropriate thickness in the wall thickness direction (10 μm or more and preferably 100 μm or less) in the outer surface layer of the pipe, since it is possible to inhibit the hydrogen ingress through the outer surface of the pipe, there is significant improvement in sulfide stress cracking resistance and corrosion resistance (corrosivity in other words corrosion resistance). As one example indicating a state in which a white phase is formed, the photograph of a microstructure in the vicinity of the surface of a seamless steel pipe obtained by performing etching with a Vilella (picric acid) etching solution and by using an optical microscope is shown in FIG. 1. Here, the term "white" in the present disclosure refers to the quality of having a white appearance compared with a parent phase when observed by using an ordinary optical microscope under conditions regarding brightness and contrast in which it is possible to sufficiently observe the parent phase microstructure which has been exposed by performing etching. In addition, the term "parent phase" here refers to a homogeneous phase which occupies most of the portion inside the steel other than that in the vicinity of the surface.

In the case where the thickness of a white phase in the wall thickness direction is less than 10 μm, since the thickness of the surface layer microstructure is too small to prevent hydrogen ingress, it is difficult to achieve the desired corrosion resistance. On the other hand, in the case where the thickness is more than 100 μm, there is deterioration in hot workability. Here, the thickness of a white phase in the wall thickness direction is defined as the thickness (maximum thickness) which is obtained under the condition that the maximum value of the thickness is obtained when etching with a Vilella (picric acid) etching solution is performed with various etching times within the range in which a parent phase microstructure is exposed.

In addition, in the case where the area fraction of a white phase in the outer surface of the pipe is less than 50%, since the degree of dispersion (coverage factor) in the outer surface layer of the pipe is small, it is not possible to achieve the desired corrosion resistance. Therefore, the area fraction of a white phase in the outer surface of the pipe is limited to be 50% or more, or preferably 70% or more.

Hereafter, the preferable method for manufacturing the seamless steel pipe according to the present disclosure will be described.

A steel material (round billet manufactured in a continuous casting process) having the chemical composition of stainless steel described above is charged into a heating furnace in order to heat the material. In a heating process, since the vicinity of the surface of the steel material is oxidized, Ni is relatively concentrated as a result of Cr being expended, which results in a white phase being formed in the surface layer. In order to form "surface layer microstructure" according to the present disclosure, it is particularly necessary to control the atmosphere and heating temperature of the heating furnace.

In the present disclosure, the oxygen concentration in the atmosphere of the heating furnace is set to be 2 vol. % or more and 5 vol. % or less. In the case where the oxygen concentration in the atmosphere of the heating furnace is less than 2 vol. %, it is not possible to form the desired white phase. On the other hand, in the case where the oxygen concentration is more than 5 vol. %, since the thickness of a white phase in the wall thickness direction is more than 100 μm, there is deterioration in hot workability. In the present disclosure, the oxygen concentration may be controlled by controlling, for example, the ratio of the amount of a fuel used in the heating process to the amount of air and the chemical composition of the gas in the heating atmosphere.

In addition, the heating temperature is set to be 1250° C. or higher and 1300° C. or lower. In the case where the heating temperature is lower than 1250° C., it is not possible to form the desired white phase. On the other hand, in the case where the heating temperature is higher than 1300° C., since the thickness of a white phase in the wall thickness direction is more than 100 μm, there is deterioration in hot workability.

In addition, it is preferable that a holding time in a heating process be 2 hours or more and 3 hours or less. In the case where the holding time in a heating process is less than 2 hours, there is a case where it is not possible to form the desired white phase. On the other hand, in the case where the holding time is more than 3 hours, since the thickness of a white phase in the wall thickness direction is more than 100 μm, there is a case of deterioration in hot workability.

By performing a pipe-making process including piercing the heated steel material by using a piercing mill such as a piercer in order to obtain a hollow material having specified dimensions, hot-rolling the hollow material by using a hot rolling mill such as a mandrel mill or an elongator, a plug mill, and a realer, and, optionally, further performing, for example, diameter-reducing rolling by using a reducer, a sizing mill, or the like and by performing cooling at a cooling rate equal to or larger than that of air cooling, a seamless steel pipe having specified dimensions is obtained. It is not necessary to put particular limitations on the conditions of a pipe-making process or cooling conditions, and any of ordinary conditions may be used.

In the present disclosure, a quenching treatment and a tempering treatment are performed on the seamless steel pipe obtained by performing the processes described above.

A quenching treatment is a treatment in which the seamless steel pipe is heated to a temperature equal to or higher than the $Ac_3$ transformation temperature and subsequently cooled to room temperature at a cooling rate equal to or larger than that of air cooling. The quenched seamless steel pipe is subsequently subjected to a tempering treatment. A tempering treatment is a treatment in which the seamless steel pipe is heated to a temperature equal to or lower than the $Ac_1$ transformation temperature and subsequently cooled to room temperature at a cooling rate equal to or larger than that of air cooling.

Here, it is not necessary to put particular limitations on specific conditions used for quenching or tempering, and any of ordinary conditions may be used.

Hereafter, the present disclosure will be described more in detail on the basis of examples.

EXAMPLES

By degassing molten steels having the chemical compositions given in Table 1, and by casting the molten steels into steel ingots having a weight of 100 kg, steel materials were obtained. By heating these steel materials in a heating furnace under the conditions given in Table 2, by then making the steel materials into pipes by performing hot working using a model seamless rolling mill, by then performing air cooling, seamless steel pipes (having an outer diameter of 13.9 in. and a wall thickness of 4.6 in) were obtained. In Table 2, among the heating conditions of a rotary heating furnace, 100%-$N_2$ gas was used in atmosphere a: inert atmosphere, a mixed gas having an oxygen concentration of 3 vol. 1 and a nitrogen concentration of 97% was used in atmosphere b: oxidizing atmosphere, and a mixed gas having an oxygen concentration of 10 vol. % and a nitrogen concentration of 90% was used in atmosphere c: strongly oxidizing atmosphere. By observing the inner and outer surfaces of the obtained seamless steel pipes in the cooled state after the pipe-making process by preforming a visual test, it was checked whether or not cracking occurred in order to evaluate hot workability. A case where there was a crack having a length of 5 mm or more in the front or tail end surface of the pipe was judged as the case "with" a crack and marked with "x" (unsatisfactory), and cases other than that were judged as the case "without" a crack and marked with "○" (satisfactory).

Subsequently, the obtained seamless steel pipes were subjected to a quenching treatment and a tempering treatment under the conditions given in table 2.

By taking test pieces from the obtained seamless steel pipes, microstructure observation, a tensile test, a corrosion test, and a sulfide stress cracking test were performed. The testing methods were as follows.

(1) Microstructure Observation

By taking a test piece for microstructure observation from the obtained seamless steel pipe, by first polishing a cross section (C-cross section) at a right angle to the pipe axis direction, by etching the polished cross section with a Vilella (1 vol. %-picric acid+5 vol. % to 15 vol. %-hydrochloric acid+ethanol) etching solution, and by observing the portion in the vicinity of the surface of the pipe located at different places (8 places) in the circumferential direction by using an optical microscope (at a magnification of 400 times), the thickness (minimum value) of a white phase in the wall thickness direction and the phase fractions in the surface of the pipe were determined. In addition, in the determination described above, a white phase was defined as a phase having a white appearance compared with a parent phase when observed by using an ordinary optical microscope under conditions regarding brightness and contrast in which it is possible to sufficiently observe the parent phase microstructure which has been exposed by performing etching.

Here, by also observing an internal microstructure in regions other than the surface layer by using an optical microscope (at a magnification of 400 times), and by taking photographs, individual phases were identified and the phase fractions of individual phases were determined from the microstructure photographs by performing an image analysis. Here, the phase fraction of a retained austenite phase was determined by using an X-ray diffraction method at a central position in the thickness direction.

(2) Tensile Test

A round bar-type tensile test piece (having a parallel part having a diameter of 6 mmϕ and a length of 80 mm) was taken from the obtained seamless steel pipe so that the tensile direction is the pipe axis direction. Since the surface layer microstructure had been removed from the taken test piece, the test piece was subjected to a heat treatment under a condition in which the conditions of a heating furnace before a pipe-making process given in Table 2 were simulated in order to form a white phase in the surface layer of the test piece, and the treated test piece was then subjected to a quenching treatment and a tempering treatment under the conditions given in Table 2 in order to control the microstructure of the test piece. Subsequently, by performing a tensile test in accordance with the prescription in API (American Petroleum Institute)-5CT, tensile properties (yield stress YS, tensile strength TS, and elongation E1) were determined.

(3) Corrosion Test

A corrosion test piece (having a thickness of 3 mm, a width of 30 mm, and a length of 40 mm) was taken from the obtained seamless steel pipe by performing machining. Subsequently, as was done in (2), the test piece was subjected to a heat treatment under a condition in which the conditions of a heating furnace given in Table 2 were simulated in order to form a white phase in the surface layer of the test piece, the treated test piece was then subjected to a quenching treatment and a tempering treatment under the conditions given in Table 2 in order to control the microstructure of the test piece, and a corrosion test was then performed. A corrosion test was performed by immersing the corrosion test piece in a test solution, that is, a 20 mass %-NaCl aqueous solution (having a temperature of 160° C. and a $CO_2$ partial pressure of 5.0 MPa) contained in an autoclave for a immersing time of 720 hours. After the corrosion test had been performed, by determining the weight of the corrosion test piece, a corrosion rate was calculated from the difference in weight between before and after the corrosion test. A case where the corrosion rate was 0.127 mm/year or less was judged as the case of good corrosion resistance and marked with "○" (satisfactory), and cases other than that were judged as "x" (unsatisfactory).

(4) Sulfide Stress Cracking (SSC) Test

A tensile test piece (having a parallel part having a diameter of 6.4 mm+ and a length of 25.4 mm) was taken from the obtained seamless steel pipe, and, as was done in (2), the test piece was subjected to a heat treatment under a condition in which the conditions of a heating furnace given in Table 2 were simulated in order to form a white phase in the surface layer of the test piece, the treated test piece was then subjected to a quenching treatment and a tempering treatment under the conditions given in Table 2 in order to control the microstructure of the test piece, and an SSC test was then performed in accordance with NACE-TM0177-96 Method A.

The test piece was subjected to a constant-load test while being brought into contact with a 5%-NaCl+0.5%-$CH_3COOH$+$CH_3COONa$ aqueous solution (having a temperature of 25° C., a pH of 4.0, and a $H_2S$ partial pressure of 0.002 MPa). The loading stress was 90%-SMYS (Specified Minimum Yield Strength). A case where cracking did not occur after 720 hours had been passed was judged as the case of excellent sulfide stress cracking resistance (SSC resistance) and marked with "○" (satisfactory), and a case where cracking occurred was judged as "x" (unsatisfactory).

The obtained results are given in Table 3.

TABLE 1

| Steel | Chemical Composition (mass %) | | | | | | | | | | | | | | | | |
|---|---|---|---|---|---|---|---|---|---|---|---|---|---|---|---|---|---|
| Code | C | Si | Mn | P | S | Cr | Ni | Mo | N | O | V | Al | Cu | Nb, Ti, Zr, W, B | Ca | Cr/Ni | Note |
| A | 0.025 | 0.18 | 0.45 | 0.011 | 0.002 | 13.0 | 3.5 | 1.0 | 0.04 | 0.005 | 0.04 | 0.022 | — | — | 0.0010 | 3.7 | Example |
| B | 0.018 | 0.10 | 1.52 | 0.008 | 0.002 | 13.3 | 4.1 | 0.8 | 0.08 | 0.004 | 0.03 | 0.008 | — | Zr: 0.08 | 0.0007 | 3.2 | Example |
| C | 0.030 | 0.49 | 0.57 | 0.008 | 0.001 | 14.0 | 6.5 | 2.5 | 0.05 | 0.004 | 0.06 | 0.044 | — | — | 0.0012 | 2.2 | Example |
| D | 0.006 | 0.28 | 0.30 | 0.009 | 0.001 | 12.1 | 5.1 | 1.8 | 0.02 | 0.003 | 0.03 | 0.033 | — | Ti: 0.09 | 0.0008 | 2.4 | Example |
| E | 0.028 | 0.29 | 0.33 | 0.009 | 0.001 | 14.3 | 6.9 | 2.2 | 0.05 | 0.005 | 0.03 | 0.021 | 0.8 | Nb: 0.08 | 0.0009 | 2.1 | Example |
| G | 0.031 | 0.25 | 0.30 | 0.008 | 0.001 | 17.5 | 4.0 | 2.8 | 0.06 | 0.005 | 0.04 | 0.012 | 2.3 | Nb: 0.08, W: 1.1 | — | 4.4 | Example |
| H | 0.033 | 0.25 | 0.30 | 0.008 | 0.002 | 17.8 | 3.1 | 2.8 | 0.06 | 0.005 | 0.03 | 0.010 | 2.0 | Nb: 0.08, W: 0.8 | 0.0008 | 5.7 | Comparative Example |
| I | 0.005 | 1.48 | 0.21 | 0.018 | 0.004 | 11.1 | 2.1 | 3.5 | — | 0.004 | — | — | — | — | — | 5.3 | Example |
| J | 0.048 | 0.05 | 1.80 | 0.009 | 0.005 | 14.5 | 3.7 | 0.6 | — | 0.005 | — | — | — | — | — | 3.9 | Example |
| K | 0.029 | 0.08 | 0.34 | 0.007 | 0.003 | 12.8 | 3.2 | 2.4 | 0.01 | 0.004 | 0.03 | — | — | — | — | 4.0 | Example |
| L | 0.007 | 0.11 | 0.22 | 0.008 | 0.002 | 13.1 | 4.5 | 1.8 | 0.15 | 0.005 | 0.19 | — | — | — | — | 2.9 | Example |

TABLE 1-continued

| Steel | Chemical Composition (mass %) | | | | | | | | | | | | | | | | |
|---|---|---|---|---|---|---|---|---|---|---|---|---|---|---|---|---|---|
| Code | C | Si | Mn | P | S | Cr | Ni | Mo | N | O | V | Al | Cu | Nb, Ti, Zr, W, B | Ca | Cr/Ni | Note |
| M | 0.025 | 0.19 | 0.69 | 0.010 | 0.002 | 14.7 | 5.9 | 2.1 | 0.08 | 0.005 | 0.08 | 0.002 | 3.4 | Nb: 0.2, B: 0.098 | — | 2.5 | Example |
| N | 0.022 | 0.13 | 0.23 | 0.008 | 0.001 | 17.7 | 3.5 | 2.6 | 0.11 | 0.003 | — | 0.017 | — | Ti: 0.3, Zr: 0.2, W: 2.8 | — | 5.1 | Example |

An underlined portion indicates a value out of the range according to the present disclosure.
The remainder is Fe and inevitable impurities.

TABLE 2

| | | Heating Condition of Rotary Heating Furnace | | | Quenching Condition | | Tempering Condition | | |
|---|---|---|---|---|---|---|---|---|---|
| Steel Pipe No. | Steel Code | Heating Temperature (° C.) | Holding Time (min) | Atmosphere* | Heating Temperature (° C.) | Holding Time (min) | Heating Temperature (° C.) | Holding Time (min) | Note |
| 1 | A | 1270 | 120 | b | 920 | 10 | 580 | 30 | Example |
| 2 | B | 1270 | 120 | b | 920 | 10 | 620 | 140 | Example |
| 3 | C | 1280 | 180 | b | 920 | 10 | 590 | 40 | Example |
| 4 | D | 1300 | 180 | b | 920 | 10 | 590 | 30 | Example |
| 5 | E | 1300 | 120 | b | 920 | 20 | 580 | 150 | Example |
| 7 | G | 1300 | 120 | b | 960 | 10 | 615 | 120 | Example |
| 8 | H | 1300 | 120 | b | 960 | 10 | 620 | 120 | Comparative Example |
| 9 | H | 1280 | 120 | a | 960 | 10 | 620 | 120 | Comparative Example |
| 10 | A | 1270 | 120 | a | 920 | 10 | 580 | 30 | Comparative Example |
| 12 | B | 1300 | 120 | a | 960 | 20 | 580 | 150 | Comparative Example |
| 13 | I | 1300 | 120 | b | 980 | 20 | 620 | 60 | Example |
| 14 | J | 1300 | 120 | b | 1000 | 20 | 590 | 30 | Example |
| 15 | K | 1300 | 120 | b | 980 | 20 | 620 | 30 | Example |
| 16 | L | 1300 | 120 | b | 1000 | 20 | 620 | 30 | Example |
| 17 | M | 1280 | 120 | b | 920 | 10 | 620 | 120 | Example |
| 18 | N | 1280 | 120 | b | 920 | 10 | 620 | 30 | Example |
| 19 | C | 1280 | 180 | a | 920 | 10 | 590 | 40 | Comparative Example |
| 20 | D | 1300 | 180 | a | 920 | 10 | 590 | 30 | Comparative Example |
| 21 | E | 1300 | 120 | a | 920 | 20 | 580 | 150 | Comparative Example |
| 22 | G | 1300 | 120 | a | 960 | 10 | 615 | 120 | Comparative Example |
| 23 | A | 1270 | 120 | c | 920 | 10 | 580 | 30 | Comparative Example |

*a: inert atmosphere (oxygen concentration: 0 vol. %, and nitrogen concentration: 100 vol. %) b: oxidizing atmosphere (oxygen concentration: 3 vol. %, and nitrogen concentration: 97 vol. %) c: strongly oxidizing atmosphere (oxygen concentration: 10 vol. %, and nitrogen concentration: 90 vol. %)

TABLE 3

| | | Microstructure | | | | | Tensile Property | | | | | | |
|---|---|---|---|---|---|---|---|---|---|---|---|---|---|
| | | | Internal Microstructure Fraction (vol. %) | | Surface Layer Microstructure White Phase | | | | | Hot Workability without Crack: ○ | | | |
| Steel Pipe No. | Steel Code | Class* | Main Phase | Second Phase | Depth in Thickness Direction** (μm) | Surface Area Fraction (%) | Yield Stress YS (MPa) | Tensile Strength TS (MPa) | Elongation El (%) | with Crack: X | Corrosion Resistance Evaluation | SSC Resistance Evaluation | Note |
| 1 | A | M + γ | M: 95 | γ: 5 | 23 | 100 | 820 | 908 | 23.1 | ○ | ○ | ○ | Example |
| 2 | B | M + γ | M: 93 | γ: 7 | 33 | 100 | 683 | 831 | 23.9 | ○ | ○ | ○ | Example |
| 3 | C | M + γ | M: 94 | γ: 6 | 38 | 100 | 821 | 907 | 22.9 | ○ | ○ | ○ | Example |
| 4 | D | M + γ | M: 96 | γ: 4 | 26 | 100 | 822 | 910 | 22.2 | ○ | ○ | ○ | Example |
| 5 | E | M + γ | M: 79 | γ: 21 | 52 | 100 | 956 | 1022 | 23.8 | ○ | ○ | ○ | Example |
| 7 | G | M + γ + F | M: 59 | F: 30, γ: 11 | 30 | 100 | 779 | 1026 | 24.1 | ○ | ○ | ○ | Example |
| 8 | H | M + γ + F | M: 61 | F: 31, γ: 8 | 0 | 19 | 783 | 933 | 23.8 | ○ | ○ | X | Comparative Example |
| 9 | H | M + γ + F | M: 61 | F: 29, γ: 10 | 0 | 0 | 788 | 935 | 24.6 | ○ | ○ | X | Comparative Example |
| 10 | A | M + γ | M: 92 | γ: 8 | 0 | 0 | 814 | 901 | 23.0 | ○ | ○ | X | Comparative |
| 12 | B | M + γ | M: 95 | γ: 5 | 0 | 13 | 705 | 855 | 23.7 | ○ | ○ | X | Comparative |
| 13 | I | M + γ | M: 91 | γ: 9 | 49 | 100 | 969 | 1024 | 22.3 | ○ | ○ | ○ | Example |
| 14 | J | M + γ | M: 95 | γ: 5 | 51 | 59 | 801 | 926 | 21.4 | ○ | ○ | ○ | Example |

TABLE 3-continued

| Steel Pipe No. | Steel Code | Microstructure: Internal Microstructure Class* | Fraction (vol. %) Main Phase | Second Phase | Surface Layer Microstructure: White Phase Depth in Thickness Direction** (μm) | Surface Area Fraction (%) | Tensile Property: Yield Stress YS (MPa) | Tensile Strength TS (MPa) | Elongation El (%) | Hot Workability without Crack: ○ with Crack: X | Corrosion Resistance Evaluation | SSC Resistance Evaluation | Note |
|---|---|---|---|---|---|---|---|---|---|---|---|---|---|
| 15 | K | M + γ | M: 90 | γ: 10 | 92 | 77 | 792 | 918 | 22.0 | ○ | ○ | ○ | Example |
| 16 | L | M + γ | M: 89 | γ: 11 | 29 | 89 | 769 | 895 | 23.1 | ○ | ○ | ○ | Example |
| 17 | M | M + γ | M: 92 | γ: 8 | 13 | 100 | 829 | 926 | 22.6 | ○ | ○ | ○ | Example |
| 18 | N | M + γ + F | M: 62 | F: 22, γ: 16 | 54 | 100 | 783 | 932 | 24.8 | ○ | ○ | ○ | Example |
| 19 | C | M + γ | M: 92 | γ: 8 | 0 | 0 | 688 | 840 | 22.4 | ○ | ○ | X | Comparative Example |
| 20 | D | M + γ | M: 93 | γ: 7 | 0 | 0 | 712 | 862 | 22.7 | ○ | ○ | X | Comparative Example |
| 21 | E | M + γ | M: 77 | γ: 23 | 0 | 0 | 789 | 911 | 22.5 | ○ | ○ | X | Comparative Example |
| 22 | G | M + γ + F | M: 58 | F: 30, γ: 12 | 0 | 0 | 955 | 1026 | 23.8 | ○ | ○ | X | Comparative Example |
| 23 | A | M + γ | M: 90 | γ: 10 | 168 | 100 | 819 | 906 | 23.3 | X | ○ | X | Comparative Example |

*M: martensite (tempered), F: ferrite, and γ: retained austenite
**minimum value (μm)

All the examples of the present disclosure were high-strength seamless stainless steel pipes for oil country tubular goods having a high strength corresponding to a yield stress of 654 MPa or more, excellent hot workability, excellent corrosion resistance even in a high-temperature harsh corrosive environment containing $CO_2$, $Cl^-$, and so forth and having a temperature higher than 160° C., and excellent sulfide stress cracking resistance. On the other hand, the comparative examples, which were out of the range according to the present disclosure, had deteriorated sulfide stress cracking resistance (SSC resistance), and steel pipe No. 23 further had deteriorated hot workability.

The invention claimed is:

1. A high-strength seamless stainless steel pipe for oil country tubular goods, the steel pipe comprising:

a chemical composition containing Cr and Ni and that satisfies expression (1)

$$Cr/Ni \leq 5.3 \quad (1),$$

where Cr and Ni respectively denote the contents (mass %) of the corresponding chemical elements; and a microstructure including mainly a tempered martensite phase, wherein a surface layer microstructure of the steel pipe includes a white phase after having been subjected to etching with a Vilella etching solution, the white phase: (i) having a thickness in a wall thickness direction from an outer surface of the pipe of 10 μm or more and 100 μm or less, and (ii) being dispersed in the outer surface of the pipe in an amount of 50% or more in terms of area fraction.

2. The high-strength seamless stainless steel pipe for oil country tubular goods according to claim 1, wherein the chemical composition of the steel pipe comprises:

C: 0.005% or more and 0.05% or less, by mass %,
Si: 0.05% or more and 1.50% or less, by mass %,
Mn: 0.2% or more and 1.8% or less, by mass %,
P: 0.02% or less, by mass %,
S: 0.005% or less, by mass %,
Cr: 11% or more and 18% or less, by mass %,
Ni: 2.0% or more and 8.0% or less, by mass %, and
Mo: 0.6% or more and 3.5% or less, by mass %,
the balance being Fe and inevitable impurities.

3. The high-strength seamless stainless steel pipe for oil country tubular goods according to claim 2, wherein the chemical composition of the steel pipe further comprises one or both selected from among V: 0.02% or more and 0.2% or less, by mass % and N: 0.01% or more and 0.15% or less, by mass %.

4. The high-strength seamless stainless steel pipe for oil country tubular goods according to claim 2, wherein the chemical composition of the steel pipe further comprises one or more selected from among group A through group D below:

group A: Al: 0.002% or more and 0.050% or less, by mass %,
group B: Cu: 3.5% or less, by mass %,
group C: one or more selected from among Nb: 0.2% or less, by mass %, Ti: 0.3% or less, by mass %, Zr: 0.2% or less, by mass %, W: 3.0% or less, by mass %, and B: 0.01% or less, by mass %, and
group D: Ca: 0.01% or less, by mass %.

5. The high-strength seamless stainless steel pipe for oil country tubular goods according to claim 3, wherein the chemical composition of the steel pipe further comprises one or more selected from among group A through group D below:

group A: Al: 0.002% or more and 0.050% or less, by mass %,
group B: Cu: 3.5% or less, by mass %,
group C: one or more selected from among Nb: 0.2% or less, by mass %, Ti: 0.3% or less, by mass %, Zr: 0.2% or less, by mass %, W: 3.0% or less, by mass %, and B: 0.01% or less, by mass %, and
group D: Ca: 0.01% or less, by mass %.

6. A method for manufacturing a high-strength seamless stainless steel pipe for oil country tubular goods, the method comprising:

heating a steel material in a heating furnace in an atmosphere having an oxygen concentration of 2% or more and 5% or less in terms of volume fraction at a temperature of 1250° C. or higher and 1300° C. or lower, wherein the steel material contains Cr and Ni and satisfies relational expression (1)

$$Cr/Ni \leq 5.3 \quad (1),$$

where Cr and Ni respectively denote the contents (mass %) of the corresponding chemical elements forming the steel material into a seamless steel pipe, performing a quenching treatment and a tempering treatment on the seamless steel pipe, wherein:

the seamless steel pipe has a microstructure including mainly a tempered martensite phase, a surface layer microstructure of the seamless steel pipe includes a white phase after having been subjected to etching with a Vilella etching solution, the white phase: (i) having a thickness in a wall thickness direction from an outer surface of the pipe of 10 μm or more and 100 μm or less, and (ii) being dispersed in the outer surface of the pipe in an amount of 50% or more in terms of area fraction.

7. The method for manufacturing a high-strength seamless stainless steel pipe for oil country tubular goods according to claim 6, wherein a chemical composition of the steel material comprises:

C: 0.005% or more and 0.05% or less, by mass %,

Si: 0.05% or more and 1.50% or less, by mass %,

Mn: 0.2% or more and 1.8% or less, by mass %,

P: 0.02% or less, by mass %,

S: 0.005% or less, by mass %,

Cr: 11% or more and 18% or less, by mass %,

Ni: 2.0% or more and 8.0% or less, by mass %, and

Mo: 0.6% or more and 3.5% or less, by mass %, the balance being Fe and inevitable impurities.

8. The method for manufacturing a high-strength seamless stainless steel pipe for oil country tubular goods according to claim 7, wherein the chemical composition of the steel material further comprises one or both selected from among V: 0.02% or more and 0.2% or less, by mass % and N: 0.01% or more and 0.15% or less, by mass %.

9. The method for manufacturing a high-strength seamless stainless steel pipe for oil country tubular goods according to claim 7, wherein the chemical composition of the steel material further comprises one or more selected from among group A through group D below:

group A: Al: 0.002% or more and 0.050% or less, by mass %, group B: Cu: 3.5% or less, by mass %, group C: one or more selected from among Nb: 0.2% or less, by mass %, Ti: 0.3% or less, by mass %, Zr: 0.2% or less, by mass %, W: 3.0% or less, by mass %, and B: 0.01% or less, by mass %, and group D: Ca: 0.01% or less, by mass %.

10. The method for manufacturing a high-strength seamless stainless steel pipe for oil country tubular goods according to claim 8, wherein the chemical composition of the steel material further comprises one or more selected from among group A through group D below:

group A: Al: 0.002% or more and 0.050% or less, by mass %, group B: Cu: 3.5% or less, by mass %, group C: one or more selected from among Nb: 0.2% or less, by mass %, Ti: 0.3% or less, by mass %, Zr: 0.2% or less, by mass %, W: 3.0% or less, by mass %, and B: 0.01% or less, by mass %, and group D: Ca: 0.01% or less, by mass %.

11. The method for manufacturing a high-strength seamless stainless steel pipe for oil country tubular goods according to claim 6, wherein a holding time of the heating is 2 hours or more and 3 hours or less.

* * * * *